US005815062A

United States Patent [19]

Koyuhara et al.

[11] Patent Number: 5,815,062

[45] Date of Patent: Sep. 29, 1998

[54] MAGNETIC CORE

[75] Inventors: Norikazu Koyuhara, Tottori; Youichi Yamamoto, Yazu-gun; Toshihiko Tanaka, Iwami-gun, all of Japan

[73] Assignees: Hitachi Metal, Ltd., Tokyo; Hitachi Ferrite Electronics, Ltd., Tottori, both of Japan

[21] Appl. No.: 809,205

[22] PCT Filed: Jun. 28, 1996

[86] PCT No.: PCT/JP96/01807

§ 371 Date: Feb. 28, 1997

§ 102(e) Date: Feb. 28, 1997

[87] PCT Pub. No.: WO97/02293

PCT Pub. Date: Jan. 23, 1997

[30] Foreign Application Priority Data

Jun. 30, 1995 [JP] Japan ..... 7-165075

[51] Int. Cl.[6] ..... H01F 17/06; H01F 27/24

[52] U.S. Cl. ..... 336/233; 336/178; 336/234; 336/172; 336/212

[58] Field of Search ..... 336/178, 172, 336/233, 234, 212, 214, 215

[56] References Cited

U.S. PATENT DOCUMENTS

| | | | |
|---|---|---|---|
| 1,859,115 | 5/1932 | Summers | 336/223 |
| 2,664,541 | 12/1953 | Henderson | 336/234 |
| 2,890,428 | 6/1959 | Sikorra | 336/215 |
| 3,624,575 | 11/1971 | Muller et al. | 336/234 |
| 3,626,343 | 12/1971 | Bohlke | 335/281 |
| 4,202,031 | 5/1980 | Hesler et al. | 336/178 |
| 4,409,523 | 10/1983 | Yasumura | 315/317 |
| 4,675,615 | 6/1987 | Ramanti | 336/215 |
| 4,874,990 | 10/1989 | Dobnick | 336/178 |

FOREIGN PATENT DOCUMENTS

| | | | |
|---|---|---|---|
| 4-85910 | 3/1992 | Japan | 336/233 |

*Primary Examiner*—Michael L. Gellner
*Assistant Examiner*—Anh Mai
*Attorney, Agent, or Firm*—Sughrue, Mion, Zinn Macpeak & Seas, PLLC

[57] ABSTRACT

In the magnetic core including a first leg portion around which a wire is wound, a second leg portion for circulating a magnetic flux generated in the first leg portion, and a web portion connecting the first leg portion and the second leg portion, a magnetic gap is provided in a rear area extending from the root of the first leg portion. With the magnetic gap, a magnetic flux leaking outwardly from a rear area extending from the root of the first leg portion is drastically reduced.

10 Claims, 16 Drawing Sheets

MAGNETIC CORE

FIELD OF THE INVENTION

The present invention relates to a magnetic core for use in transformers, choke coils, etc., and particularly to a magnetic core with reduced leakage flux and suitable for transformers used in power factor improving circuits, power supply transformers for CRT color monitors, etc.

BACKGROUND OF THE INVENTION

Magnetic cores used for power supply transformers, etc. are conventionally made of magnetic materials such as ferrite, silicon steel plates, etc. An E type ferrite magnetic core is shown as one example of the conventional magnetic cores in FIG. 20. This magnetic core is constituted by a pair of E type ferrite magnetic core pieces 200, 200 abutting each other, and each E type ferrite magnetic core piece 200 comprises an intermediate leg portion 251, outer leg portions 252, 252 positioning on both sides thereof, and a web portion 253 connecting the intermediate leg portion 251 and the outer leg portions 252, 252. FIG. 21 shows a pair of assembled E type ferrite magnetic core pieces with a wound wire 254. When current is applied to the wire 254, a magnetic flux 255 is generated and circulates through the web portion 253, the intermediate leg portion 251 and the outer leg portions 252, 252. This is true of magnetic cores made of other magnetic materials.

When a conventional magnetic core constituted by a pair of E type ferrite magnetic core pieces 200, 200 and a wire wound around an intermediate leg portion 251 of the magnetic core is operated, there is a leakage flux 256 emanating from the magnetic core along the extension of the intermediate leg portion 251 in addition to the above magnetic flux 255 as shown in FIG. 21. The leakage flux 256 goes outwardly from the intermediate leg portion 251 in the axial direction thereof. Since the leakage flux 256 serves as noises to other electronic circuits and electronic equipments, it is desired to have such a magnetic core structure generating as small leakage flux 256 as possible.

Also known is a magnetic core structure in which each of recesses 257 is located at an outer surface of the web portion at a position of the intermediate leg portion as shown in FIG. 22, but such a structure is not fully satisfactory in reducing the leakage flux.

In view of the above problems, an object of the present invention is to provide a magnetic core with as small leakage flux as possible.

DISCLOSURE OF THE INVENTION

The magnetic core of the present invention comprises at least one magnetic core piece comprising a first leg portion around which a wire is wound, a second leg portion for circulating a magnetic flux generated in the first leg portion, and a web portion connecting the first leg portion and the second leg portion, the web portion being provided with a magnetic gap in a rear area extending from the root of the first leg portion.

Preferably, the magnetic core of the present invention comprises (a) a pair of E type magnetic core pieces each comprising a first leg portion around which a wire is wound, second leg portions for circulating a magnetic flux generated in the first leg portion, and a web portion connecting the first leg portion and the second leg portions, and (b) at least one I type magnetic core piece, a pair of the E type magnetic core pieces being attached to each other such that their respective first leg portions and second leg portions abut each other, the I type magnetic core piece being attached to an outer surface of the web portion of at least one E type magnetic core piece, a recess being provided in at least one of the E type magnetic core pieces and the I type magnetic core piece on an interface of both magnetic core pieces, and the recess being located in a rear area extending from the root of the first leg portion of the E type magnetic core piece.

In the present invention, the magnetic gap may be provided by a through hole or a low-permeability member. In any case, the width or cross-sectional area of the magnetic gap is preferably half or more as large as that of the first leg portion (intermediate leg portion). The magnetic gap preferably has a symmetrical shape with respect to a center axis of the first leg portion (intermediate leg portion).

It is also preferable that the magnetic gap is provided by combining a pair of magnetic core pieces at least one of which has a recess, and that a magnetic core piece outside the magnetic gap is formed by a magnetic material having a higher permeability than that of the magnetic core piece inside the magnetic gap.

BRIEF DESCRIPTION OF THE DRAWINGS

FIG. 1(*b*) is a schematic view showing an E type magnetic core piece according to one embodiment of the present invention;

BEST MODE FOR CARRYING OUT THE INVENTION

[1] Structure of magnetic core

The present invention is applicable to any magnetic core structures such as E—E type magnetic cores, E–I type magnetic cores, etc., and detailed description will be made herein on the E—E type magnetic cores or the E–I type magnetic cores for the simplicity of explanation. In the E type magnetic core piece constituting the E—E type magnetic core or the E–I type magnetic core, a first leg portion around which a wire is wound corresponds to an intermediate leg portion, and a second leg portion corresponds to an outer leg portion.

Figure 1:
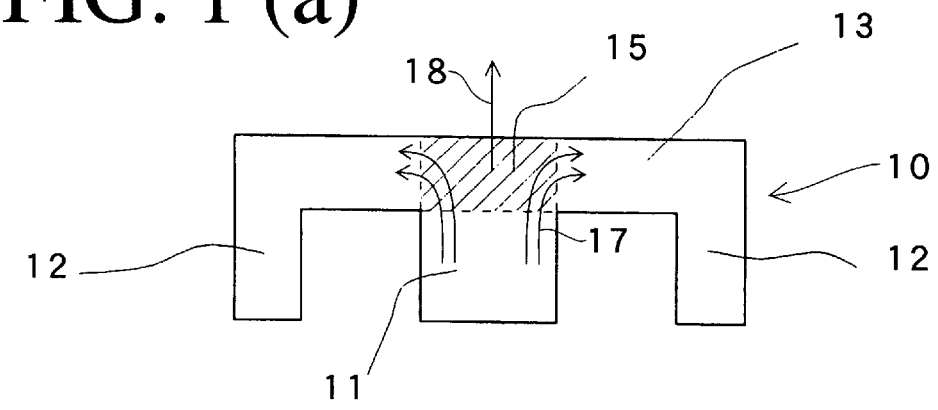
FIG. 1(*a*) is a schematic view showing the flow of a magnetic flux in an E type magnetic core piece.
Figure 1:
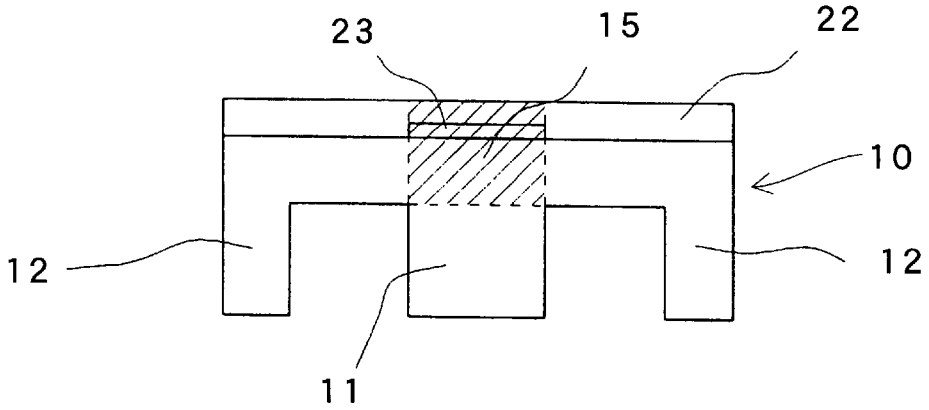

As is shown in FIG. 1(*a*), the E type magnetic core piece 10 is composed of an intermediate leg portion 11, outer leg portions 12, 12, and a web portion 13 connecting these leg portions. A magnetic flux 17 flowing through the intermediate leg portion 11 under the influence of a magnetic field generated from a wire wound around the intermediate leg portion 11 tends to partially emanate from the web portion 13 outwardly as a leakage flux 18.

Figure 2:
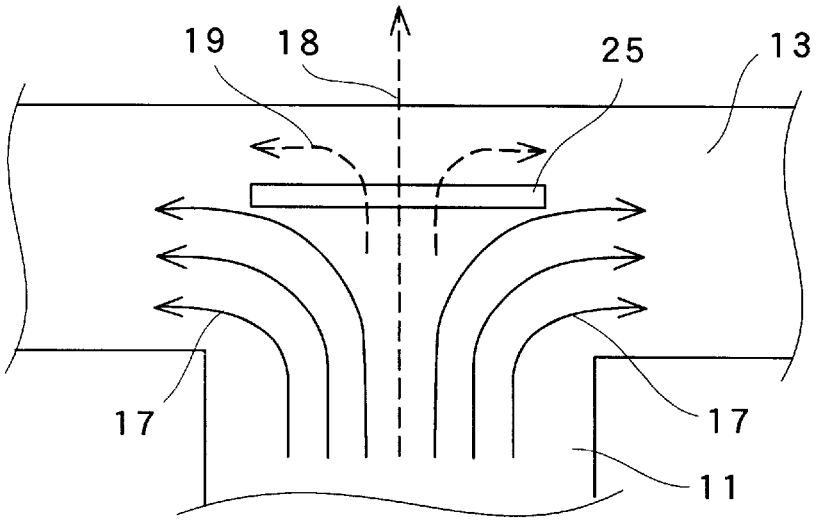
FIG. 2 is a schematic view showing the structure of the magnetic core piece of the present invention in the vicinity of the root of the intermediate leg portion thereof.

As is shown in FIG. 2, a through hole 25 provided in a root extension area of the intermediate leg portion 11 serves to increase a magnetic resistance, thereby reducing a magnetic flux flowing outwardly from the web portion 13. Thus, the generation of the leakage flux 18 is suppressed. That is, the through hole 25 acts as a magnetic gap. Due to the function of the through hole 25 as a magnetic gap, the magnetic flux 17 which would otherwise be a leakage flux 18 flows through the web portion 13 to the outer leg portions 12. Even if there is slightly a magnetic flux 17 passing through the through hole 25, it would flow through a magnetic material body outside the through hole 25 after passing therethrough, and then flow through the web portion 13 to the outer leg portions 12, thereby extremely reducing the leakage flux 18.

The term "root extension area" used herein means a rear area extending from the root or base of the intermediate leg portion 11 inside the web portion 13 along the extension axis of the intermediate leg portion 11. The root extension area is shown as a hatched area 15 in FIGS. 1(*a*) and (*b*).

As is shown in FIG. 1(*b*), the magnetic gap can be produced, for instance, by bonding or attaching an I type magnetic core piece 22 with a recess to an outer surface of the web portion 13 of the E type magnetic core piece 10 so that a through hole 23 is provided between both magnetic core pieces. Thus, in the case of attaching an additional magnetic core piece too, the hatched area 15 is a root extension area of the intermediate leg portion in the web portion.

It is preferable in the present invention that a magnetic gap constituted by a through hole, etc. is disposed in an area crossing the center axis of the first leg portion (intermediate leg portion in the embodiment shown in FIG. 1). Particularly considering the balance of a magnetic circuit, the magnetic gap preferably has a cross section symmetrical with respect to the center axis of the intermediate leg portion.

Figure 3:
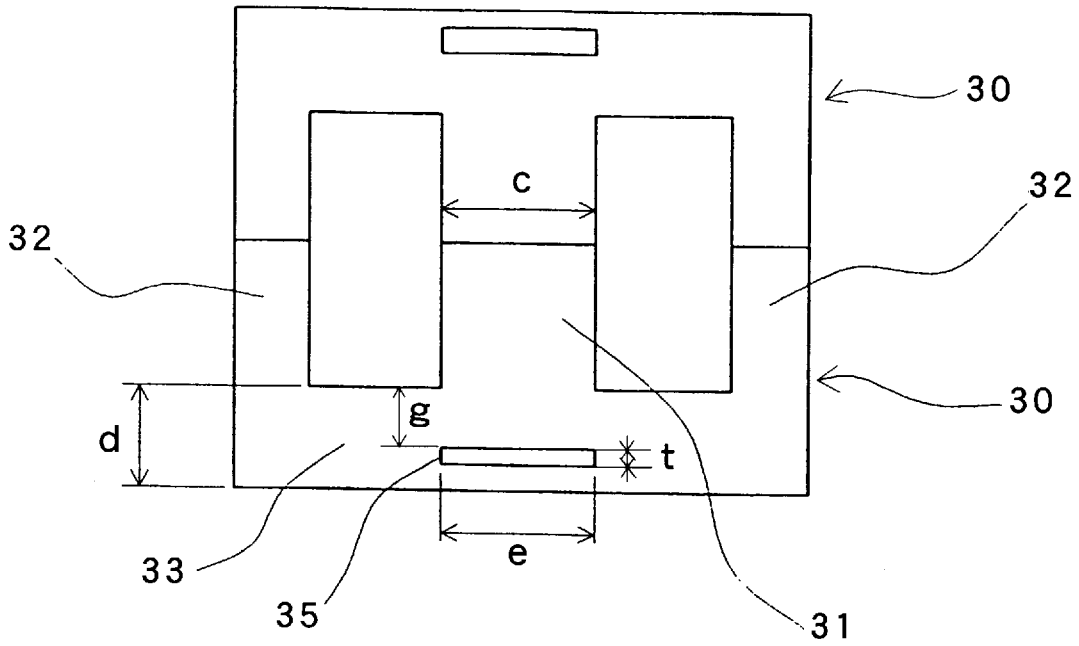
FIG. 3 is a front view showing the magnetic core according to one embodiment of the present invention.

FIG. 3 shows a magnetic core according to another embodiment of the present invention. The magnetic core in this embodiment has a structure in which a pair of E type magnetic core pieces 30, 30 abut each other, and each E type ferrite magnetic core piece 30 comprises an intermediate leg portion 31, two outer leg portions 32, 32 and a web portion 33 connecting the intermediate leg portion 31 and the outer leg portions 32, a through hole 35 being provided in a root extension area of the intermediate leg portion 31. In this embodiment, the width e of the through hole 35 is equal to the width c of the intermediate leg portion 31. The thickness (depth) t of the through hole 35 in the direction of the axis of the intermediate leg portion 31 does not depend on the width d of the web portion 33, and the through hole 35 functions effectively if it is as thick as about 0.1 mm or more. Though the through hole 35 is rectangular in this embodiment, it may have a rounded rectangular or oval shape.

Though the position of the through hole 35 is not particularly restricted as long as it is within the root extension area of the intermediate leg portion 31, the through hole 35 is preferably positioned outside of the center of the web portion 33.

Specifically, the distance g between an inside surface of the through hole 35 and an inside surface of the web portion 33 is preferably 50% or more of the width d of the web portion 33.

To achieve the maximum effect of reducing the leakage flux, the width e of the through hole 35 (maximum width when the width of the through hole 35 changes along the axis of the intermediate leg portion 31) is preferably ½ or more of the width c of the intermediate leg portion 31. The outermost side wall of the through hole 35 is preferably positioned outside of the center of the web portion 33. In sum, the following conditions are preferably met (see FIG. 3):

$$e>c/2, \text{ and}$$

$$g>d/2.$$

With respect to the cross-sectional area S of the through hole 35, the following condition:

$$S>Si/2,$$

wherein Si is a cross-sectional area of the intermediate leg portion, is preferably met in addition to the above conditions.

Figure 4:
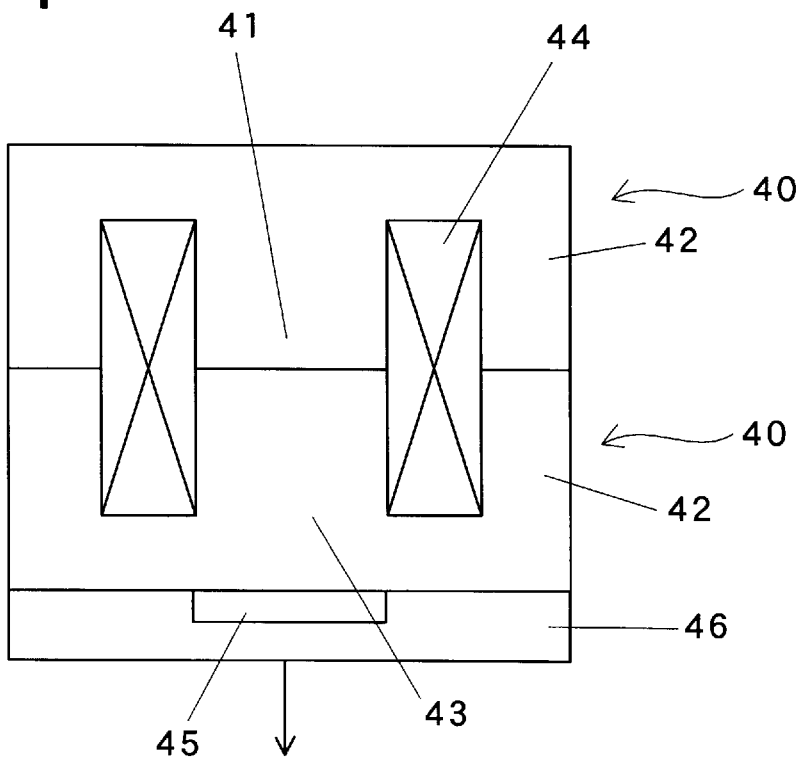
FIG. 4 is a front view showing the magnetic core according to another embodiment of the present invention.

FIG. 4 shows a magnetic core according to another embodiment of the present invention. This magnetic core is basically an E—E type magnetic core characterized by having an I type magnetic core piece to provide a through hole. The magnetic core of FIG. 4 is constituted by a pair of E type magnetic core pieces 40, 40 and an I type magnetic core piece 46 having a recess 45. Each of the E type magnetic core pieces 40 is constituted by an intermediate leg portion 41, outer leg portions 42, 42, and a web portion 43, and both E type magnetic core pieces 40 are attached to each other with their intermediate leg portions 41 and outer leg portions 42, 42 respectively in contact with each other after winding a wire 44 around the intermediate leg portions 41. The I type magnetic core piece 46 is attached to an outer surface of one E type magnetic core piece 40 with its recess 45 disposed inside. Thus, a through hole is provided in a root extension area of the intermediate leg portion 41 in the web portion 43. Of course, the I type magnetic core piece 46 may be attached to the web portions of both E type magnetic core pieces 40, 40.

Figure 5:
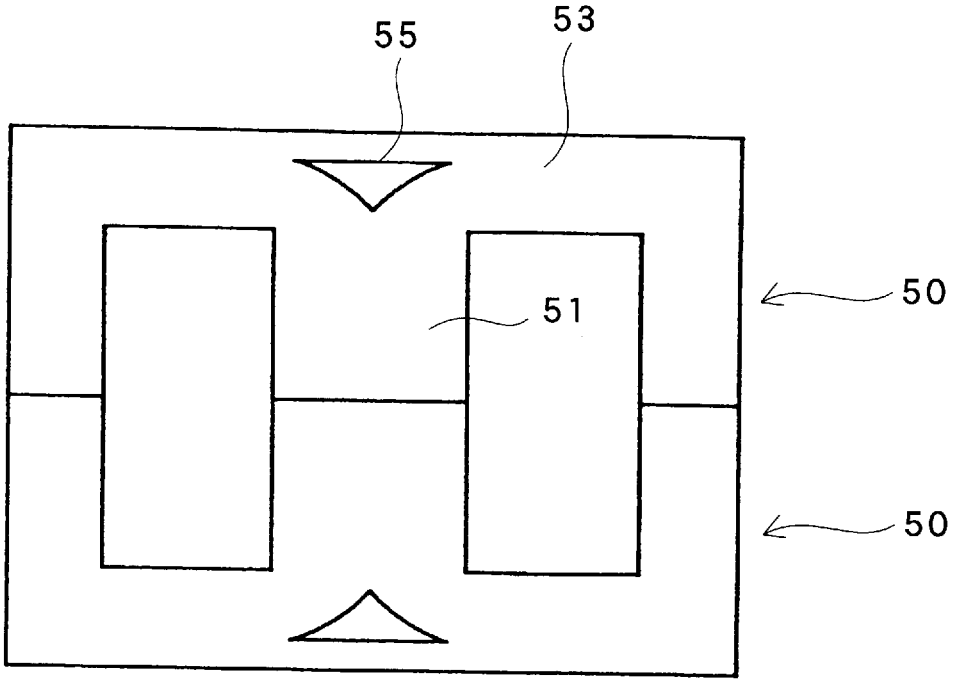
FIG. 5 is a front view showing the magnetic core according to a further embodiment of the present invention.

FIG. 5 shows a magnetic core according to a further embodiment of the present invention. The magnetic core in this embodiment comprises a pair of E type magnetic core pieces 50, 50, and each E type magnetic core piece 50 has a through hole 55 having a triangular cross section in a root extension area of the intermediate leg portion 51 in the web portion 53. Two oblique sides of the through hole 55 directed toward the inside of the E type magnetic core piece 50 are slightly curved concavely. With the through hole 55 having a width narrowing from the outer surface side of the magnetic core to the side of the intermediate leg portion 51, a magnetic flux generated in the intermediate leg portion can flow smoothly toward the outer leg portions. Thus, the shape of the through hole is not restricted in the present invention.

Like the above embodiments, to achieve the maximum effect of reducing the leakage flux, the width of the through hole 55 on the outermost side (maximum width) is preferably ½ or more of the width of the intermediate leg portion 51. The outermost side wall of the through hole is preferably positioned outside of the center of the web portion 53.

Figure 6:
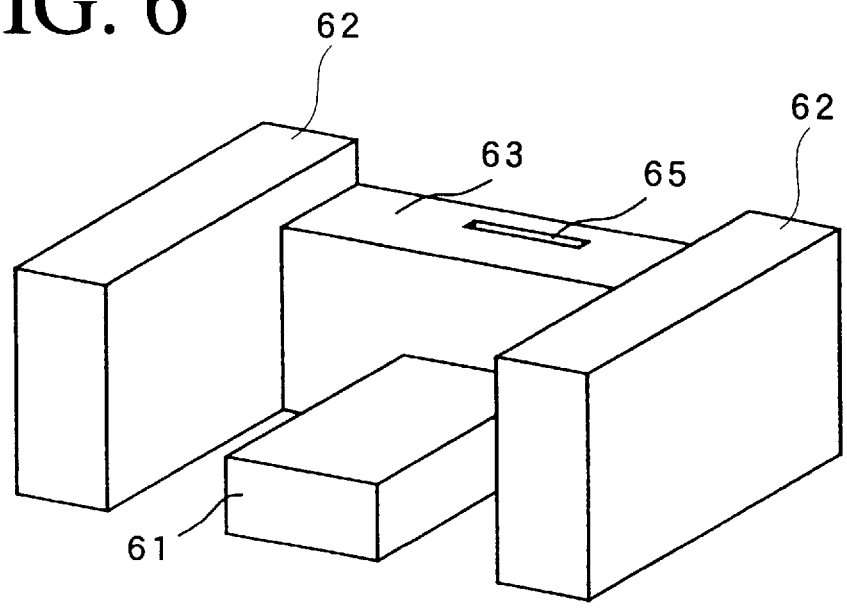
FIG. 6 is a perspective view showing the magnetic core according to a still further embodiment of the present invention.

FIG. 6 shows a magnetic core according to a still further embodiment of the present invention. The magnetic core in this embodiment is a flat E type ferrite magnetic core suitable for horizontal mounting. There is a through hole 65 in a web portion 63 from which a pair of outer leg portions 62, 62 extend, in a root extension area of the intermediate leg portion 61. The through hole 65 extends between both sides of the web portion 63.

Figure 7:
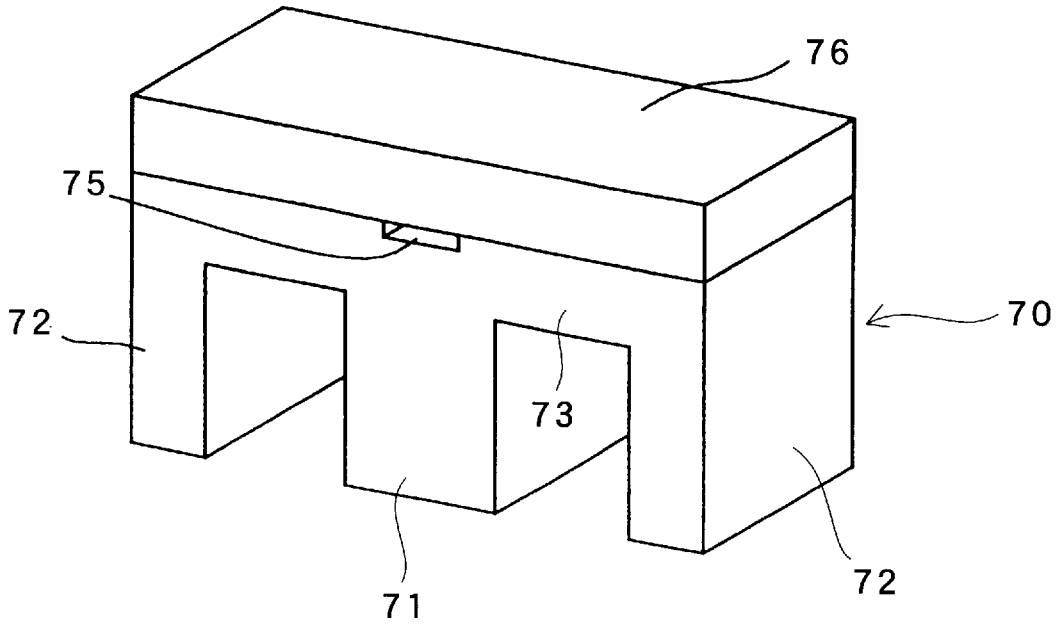
FIG. 7 is a perspective view showing the magnetic core according to a stir further embodiment of the present invention.

FIG. 7 shows a magnetic core according to a still further embodiment of the present invention. This magnetic core is constituted by an E type magnetic core piece 70 having an intermediate leg portion 71, a pair of outer leg portions 72, 72 and a web portion 73 connecting these leg portions, and an I type magnetic core piece 76. A recess 75 is provided on an outer surface of the web portion 73 in a rear area extending from the root of the intermediate leg portion 71. The I type magnetic core piece 76 is attached to the outer surface of the E type magnetic core piece 70 such that it covers the recess 75. By attaching the I type magnetic core piece 76 to the E type magnetic core piece 70, the recess 75 is turned into a through hole. Of course, the recess 75 is not restricted to the E type magnetic core piece 70, but it may be provided in the I type magnetic core piece 76 or in both magnetic core pieces 70, 76. Further, the I type magnetic core piece may be provided with a through hole.

Figure 8:
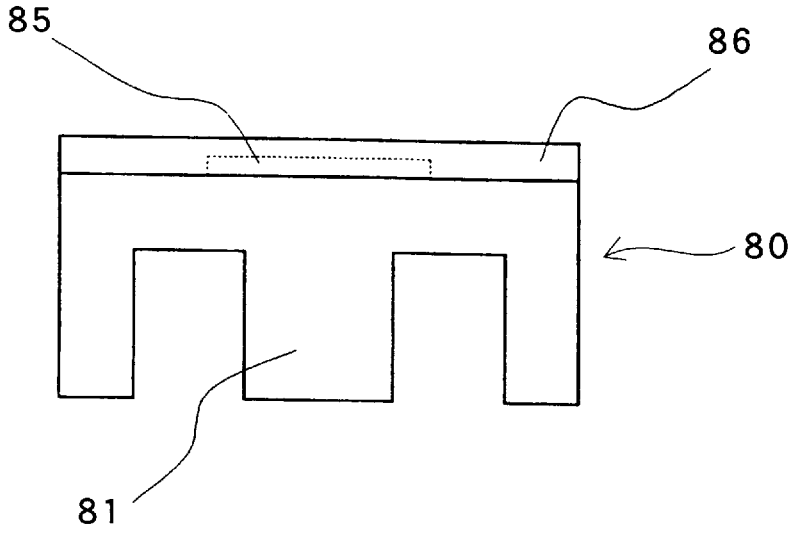
FIG. 8 is a front view showing the magnetic core according to a stile further embodiment of the present invention.
Figure 9:
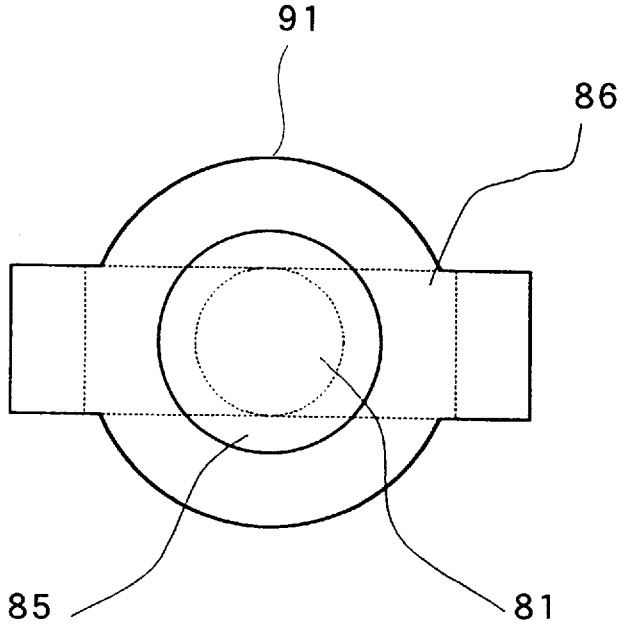
FIG. 9 is a plan view showing a recess-bearing surface of the I type magnetic core piece in FIG. 8.

FIGS. 8 and 9 show a magnetic core according to a still further embodiment of the present invention. In FIG. 9, the abutting E type magnetic core piece 80 is shown by dotted lines. This magnetic core is constituted by an E type magnetic core piece 80, and an I type magnetic core piece 86 having a circular disc portion 91 having a larger diameter than the width thereof in a center area. The circular disc portion 91 is provided with a recess 85 at a center of a lower surface thereof. By attaching the I type magnetic core piece 86 to the E type magnetic core piece 80, the recess 85 is positioned in a root extension area of the intermediate leg portion 81. With a magnetic gap constituted by the recess 85 in such a shape too, it is possible to effectively reduce the leakage flux. In the magnetic core in this embodiment, a shield effect can be expected by the circular disc portion 91 covering a wound wire (not shown).

The present invention is not restricted to the magnetic cores in the above embodiments, and it is applicable to any magnetic cores as long as they have magnetic core pieces in a shape having a first leg portion around which a wire is wound, a second leg portion for circulating a magnetic flux generated in the first leg portion, and a web portion connecting the first leg portion and the second leg portion.

The above embodiments are directed to E type magnetic core pieces having three leg portions, but the present invention is not restricted thereto. The present invention is also applicable to magnetic cores constituted by magnetic core pieces whose number of leg portions is two or four or more.

Further, the present invention is applicable to any shapes of magnetic cores such as pot-type magnetic core, etc., and each leg portion is not restricted to a rectangular cross section but may have any cross section such as circle, etc.

Further, each magnetic core piece is not restricted to have only one through hole, but it may have two or more through holes to achieve the effects of the present invention.

[2] Magnetic material (a) Material of magnetic core

The magnetic core pieces constituting the magnetic core of the present invention are preferably made of magnetic materials having high permeability, specifically ferrite, silicon steel, sendust, amorphous Fe-base alloys, amorphous Co-base alloys, nanocrystalline magnetic alloys, etc.

(b) Material of magnetic gap

The magnetic gap may be provided as a void as mentioned above, though it may be constituted by a member made of low-permeability materials embedded in the web portion in a root extension area of the intermediate leg portion. The low-permeability materials are preferably plastics, ceramics, etc.

The present invention will be explained in further detail by way of the following Examples without intention of restricting the scope of the present invention thereto.

EXAMPLE 1. CONVENTIONAL EXAMPLE 1

Figure 10:
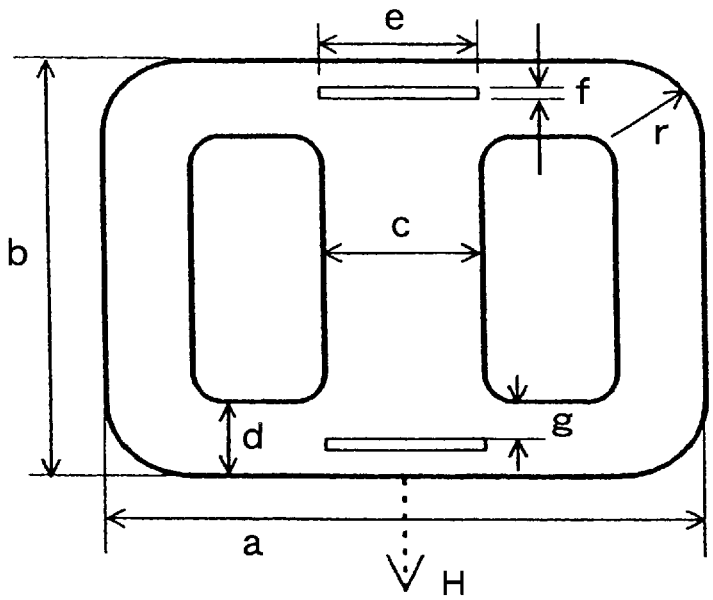
FIG. 10 is a front view showing the magnetic core according to a still further embodiment of the present invention.

With respect to a ferrite magnetic core (thickness: 17 mm) having a shape shown in FIG. 10 and a size shown below which was made of Mn—Zn ferrite (initial permeability $\mu i$=2,400, saturation magnetic flux density (800 A/m)=490 mT), the simulation of a leakage flux was carried out by a finite element method. Each part of the E type magnetic core was as follows:

a=49 mm, b=49 mm, c=16 mm, d=8 mm, and r=8 mm.

A through hole having a width e of 17 mm and a thickness (depth) t of 1.5 mm was provided in a root extension area of the intermediate leg portion in the web portion of the magnetic core. The distance g between an inside surface of the through hole and an inside surface of the web portion was 4.5 mm.

Figure 11:
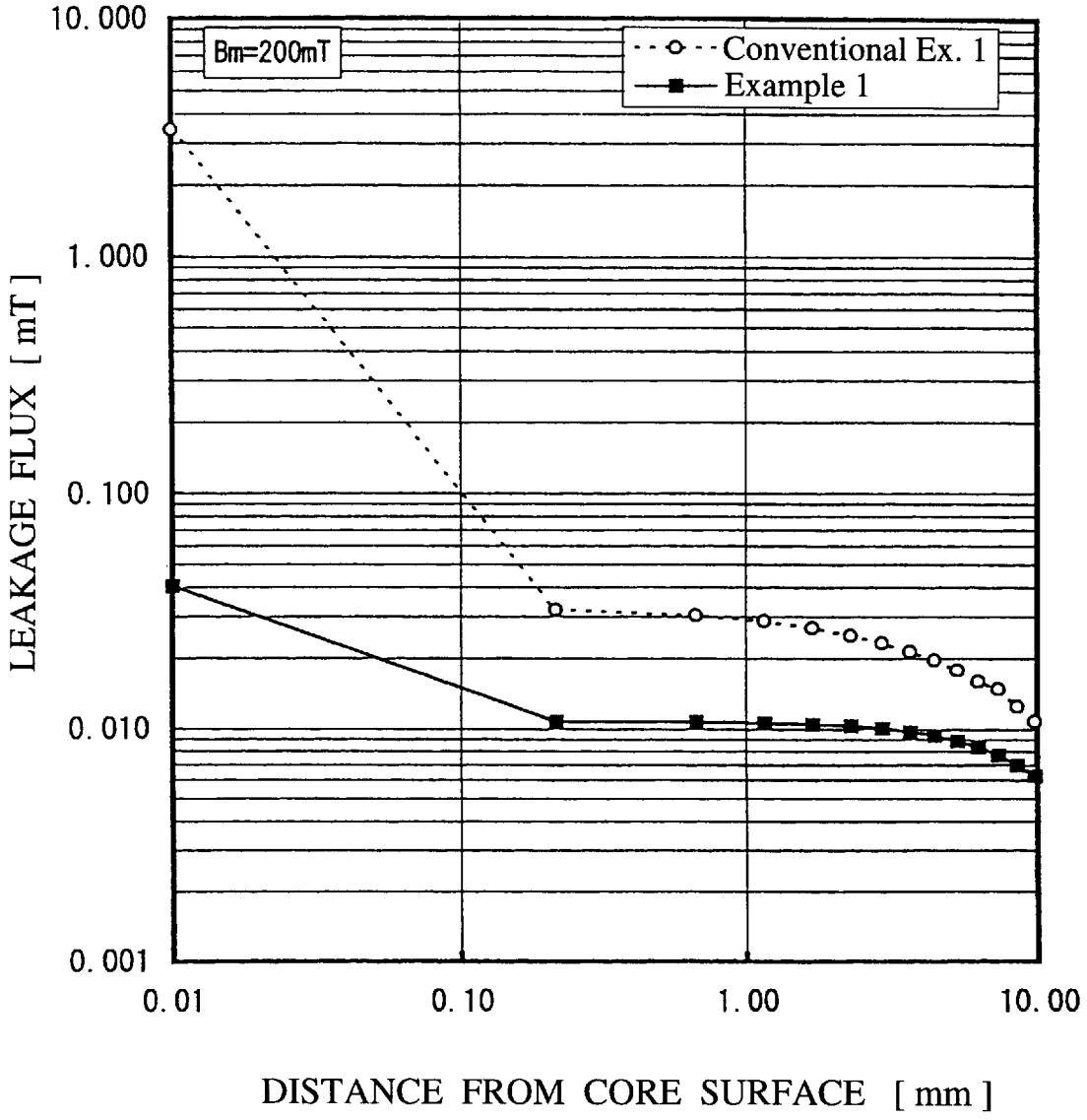
FIG. 11 is a graph showing the relation between a leakage flux and a distance from the core surface in Example 1 and Conventional Example 1.

When a magnetic field having a magnetic flux density of 200 mT was applied to this E type magnetic core, a leakage flux was generated from a portion H as shown in FIG. 11 in which the abscissa axis indicates a distance (mm) from the surface of the magnetic core, and the ordinate axis indicates a leakage flux (mT).

For comparison, the simulation of a leakage flux was carried out by applying the same magnetic field as in Example 1 on an E type magnetic core of the same material, shape and size as those of Example 1 except that no through hole was provided (Conventional Example 1). The results are also shown in FIG. 11.

As is clear from FIG. 11, the leakage flux can be extremely decreased by having the magnetic core structure of the present invention in which a through hole was provided in the root extension area of the intermediate leg portion.

EXAMPLES 2, 3 AND CONVENTION EXAMPLE 2

Figure 12:
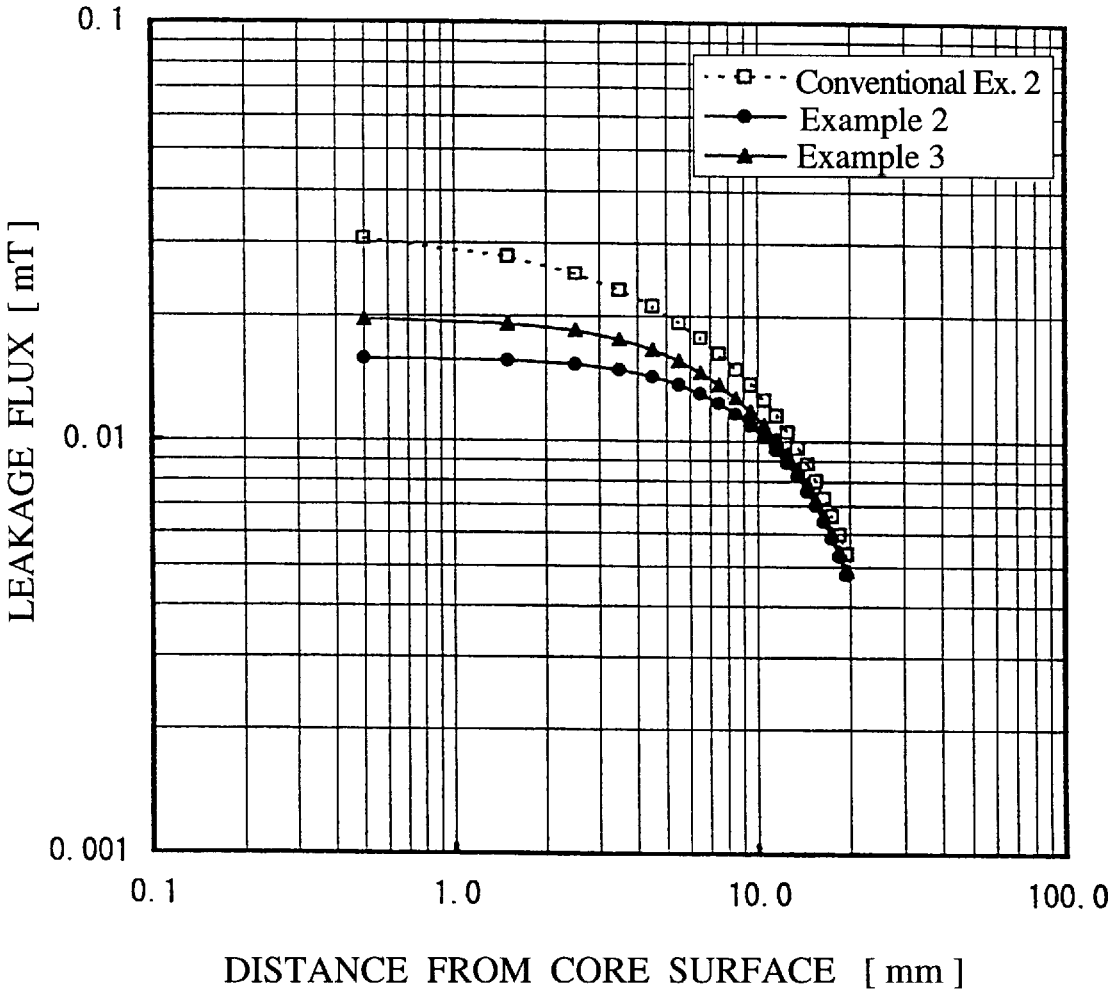
FIG. 12 is a graph showing the relation between a leakage flux and a distance from the core surface in Examples 2 and 3 and Conventional Example 2.

With respect to an E type ferrite magnetic core having a shape shown in FIG. 10 and a size shown below which was made of Mn—Zn ferrite (initial permeability $\mu i$=2,400, saturation magnetic flux density (800 A/m)=490 mT), a leakage flux was determined by simulation with a through hole having a size and position shown in Table 1. The results are shown in FIG. 12. The simulation of a leakage flux was also carried out on an E type magnetic core of the same material, shape and size as those of Examples 2 and 3 except that no through hole was provided (Conventional Example 2). The results are also shown in FIG. 12.

a=60 mm, b=60 mm, c=20 mm, and d=10 mm.

TABLE 1

| | Size of Each Portion | | |
|---|---|---|---|
| No. | e | f | g |
| Example 2 | 18 mm | 1 mm | 8 mm |
| Example 3 | 12 mm | 1 mm | 5 mm |

As is clear from FIG. 12, it is desirable to provide the through hole in the web portion outside a center thereof.

EXAMPLES 4–6 AND CONVENTIONAL EXAMPLES 3–5

With respect to an E—E type magnetic core shown in FIG. 13 (unit of dimension: mm) having the same shape as shown in FIG. 4, the simulation of a leakage flux was carried out with each of magnetic materials shown below. In any magnetic materials, a magnetic flux density of 200 mT on average was applied to the intermediate leg portion as a constraint condition in the simulation.

(1) Mn—Zn ferrite (Example 4, Conventional Example 3)

Figure 13:
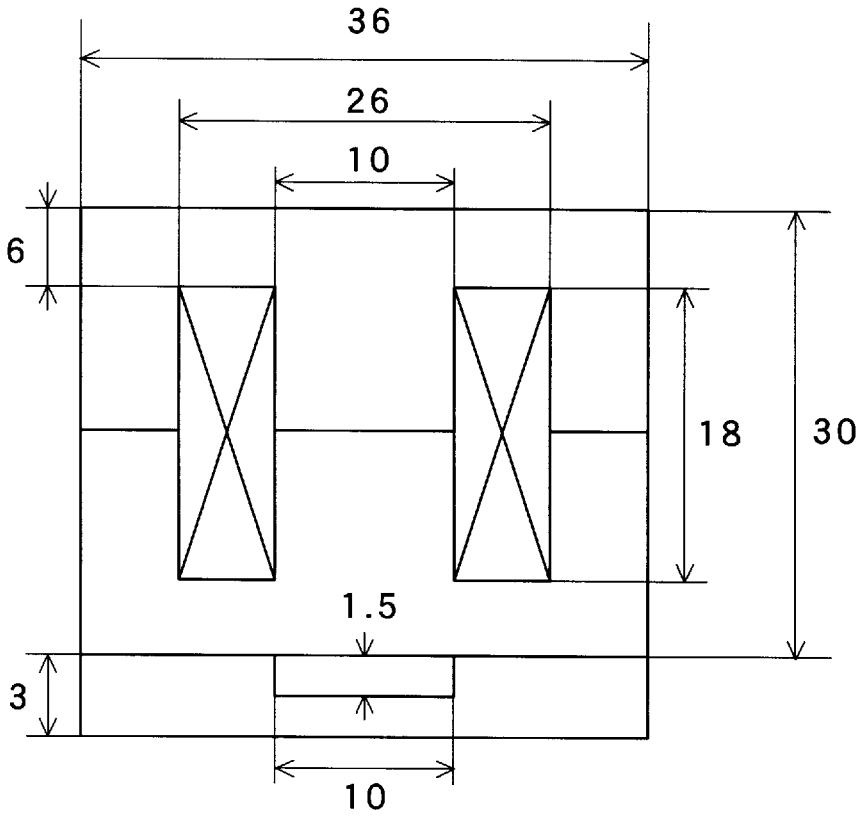
FIG. 13 is a view showing the size of each portion of the magnetic core in FIG. 4.
Figure 14:
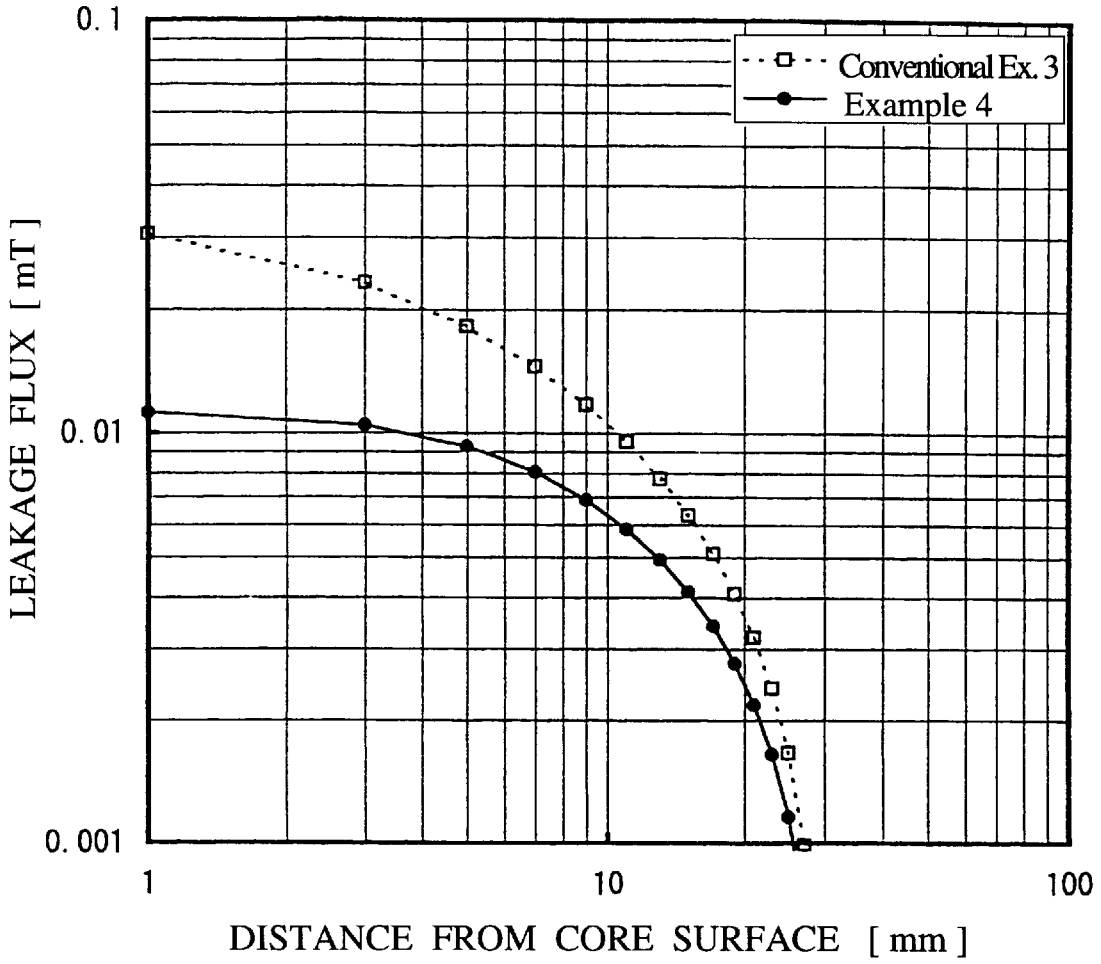
FIG. 14 is a graph showing the relation between a leakage flux and a distance from the core surface in Example 4 and Conventional Example 3.

An E type magnetic core shown in FIG. 13 was produced from Mn—Zn ferrite (initial permeability $\mu i$=2,400, saturation magnetic flux density (800 A/m)=490 mT) to carry out the simulation of a leakage flux. The results are shown in FIG. 14. The simulation of a leakage flux was also carried out on an E type magnetic core of the same material, shape and size as those of Example 4 except that no through hole was provided (Conventional Example 3). The results are also shown in FIG. 14.

(2) Silicon steel plate (Example 5, Conventional Example 4)

Figure 15:
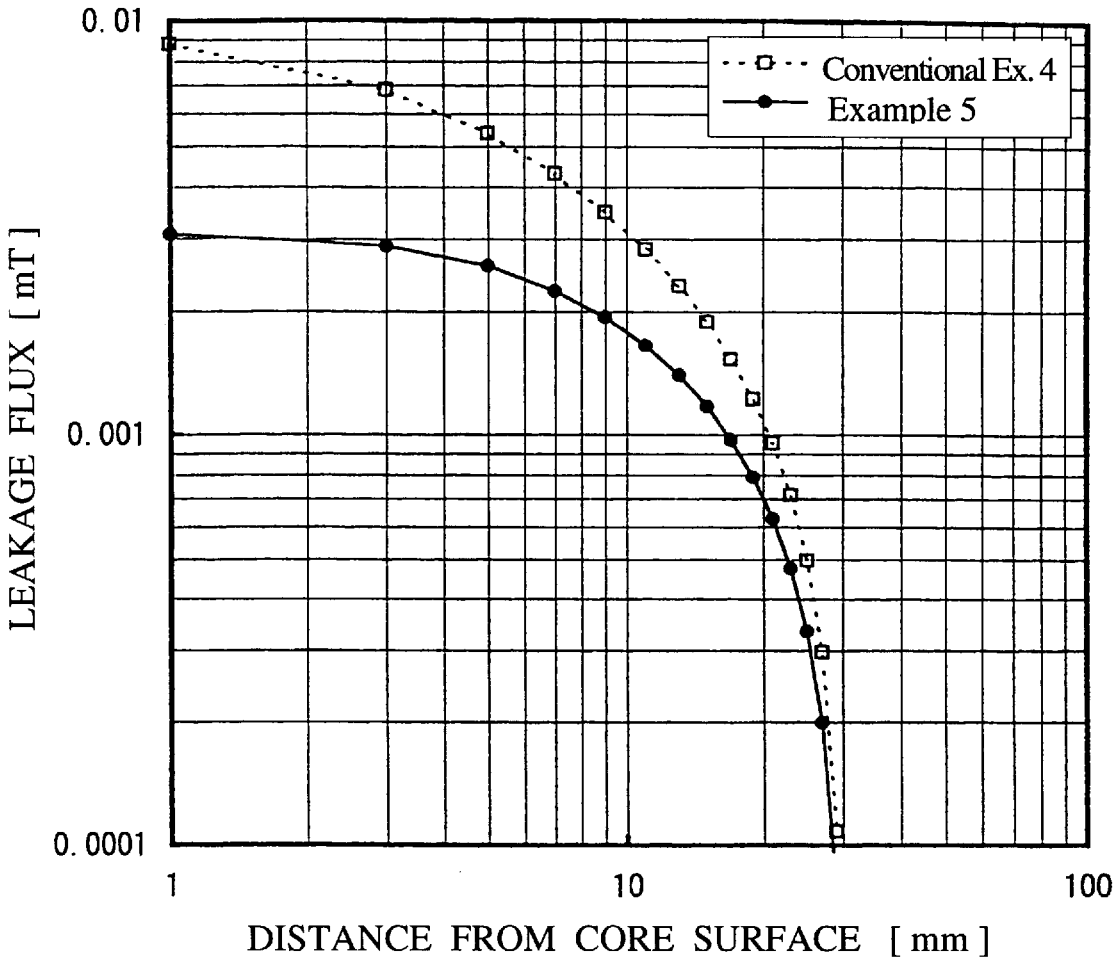
FIG. 15 is a graph showing the relation between a leakage flux and a distance from the core surface in Example 5 and Conventional Example 4.

An E type magnetic core shown in FIG. 13 was produced by silicon steel plates having a Si content of 6.5 weight % (initial permeability $\mu i$=20,000, saturation magnetic flux density (800 A/m)=1,250 mT) to carry out the simulation of a leakage flux. The results are shown in FIG. 15. The simulation of a leakage flux was also carried out on an E type magnetic core of the same material, shape and size as those of Example 5 except that no through hole was provided (Conventional Example 4). The results are also shown in FIG. 15.

(3) Sendust dust core (Example 6, Conventional Example 5)

Figure 16:
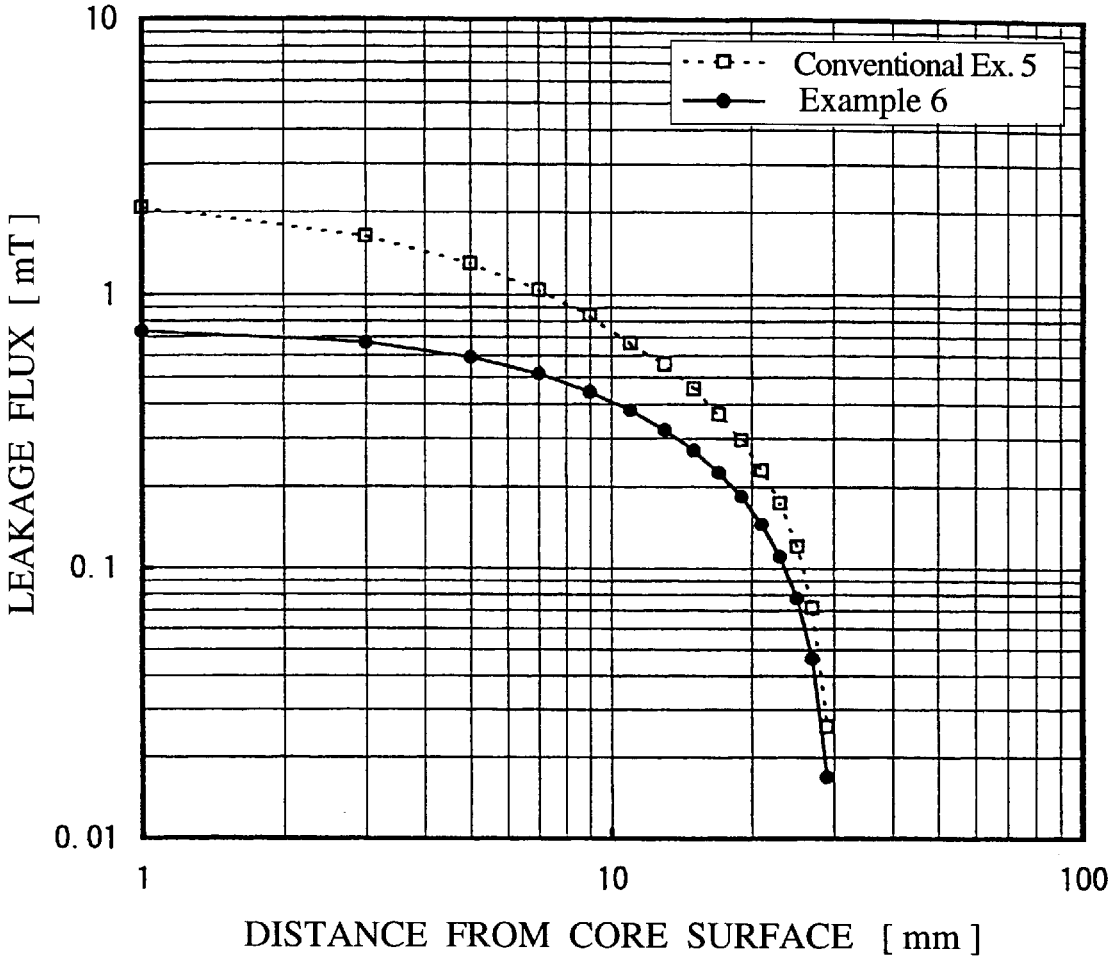
FIG. 16 is a graph showing the relation between a leakage flux and a distance from the core surface in Example 6 and Conventional Example 5.

An E type magnetic dust core shown in FIG. 13 was produced from sendust (initial permeability $\mu i$=100, saturation magnetic flux density (800 A/m)=100 mT) to carry out the simulation of a leakage flux. The results are shown in FIG. 16. The simulation of a leakage flux was also carried out on an E type magnetic core of the same material, shape and size as those of Example 6 except that no through hole was provided (Conventional Example 5). The results are also shown in FIG. 16.

As is clear from FIGS. 14–16, the effect of the present invention of extremely decreasing the leakage flux can be obtained by providing a through hole in the web portion of the magnetic core in a root extension area of the intermediate leg portion thereof, regardless of the types of magnetic materials such as ferrite, silicon steel, sendust, etc.

EXAMPLES 7–9

Figure 17:
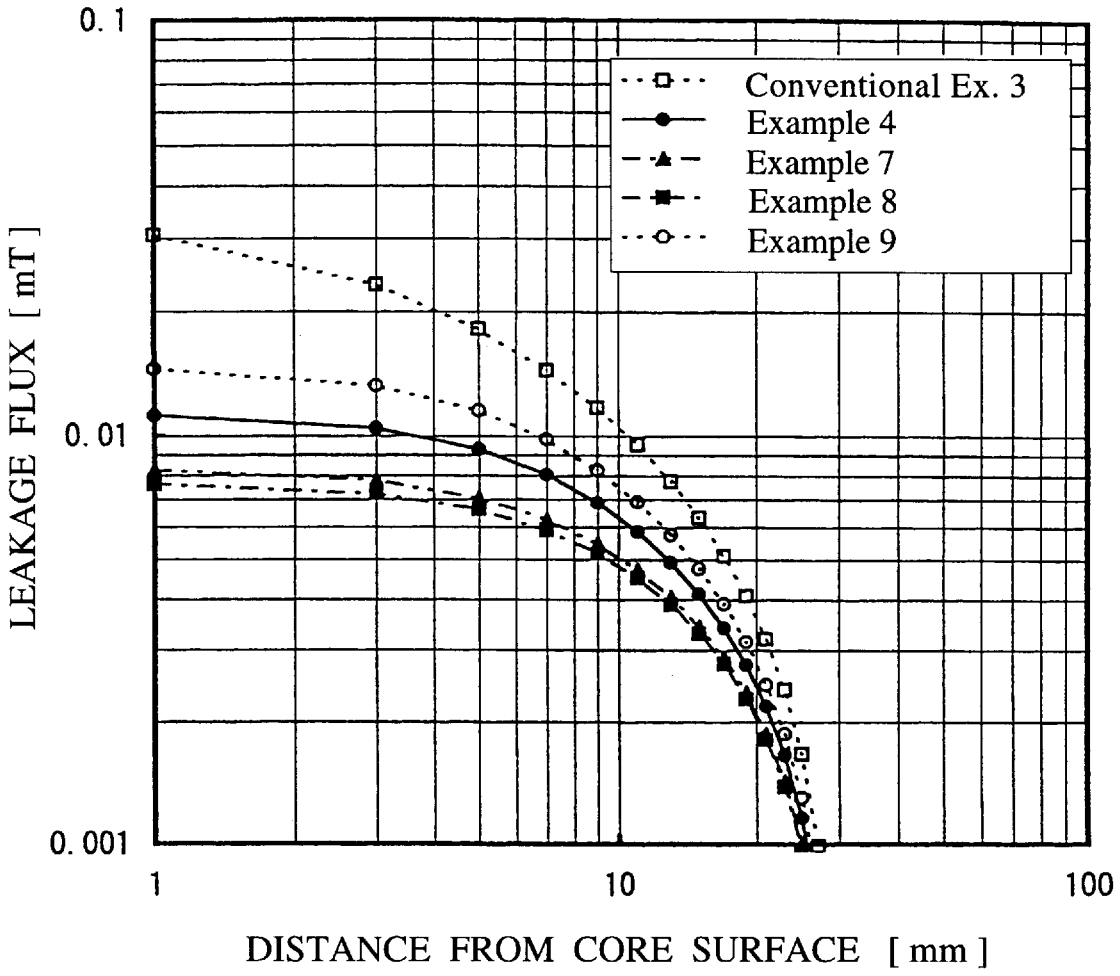
FIG. 17 is a graph showing the relation between a leakage flux and a distance from the core surface in Examples 4 and 7–9 and Conventional Example 3.

An E type magnetic core piece shown in FIG. 13 was produced from the same Mn—Zn ferrite (initial permeability $\mu i$=2,400, saturation magnetic flux density (800 A/m)=490 mT) as in Example 4, and an I type magnetic core piece was produced from various magnetic materials shown in Table 2 to carry out the simulation of a leakage flux. The simulation results are shown in FIG. 17. The results of simulation in Example 4 and Conventional Example 3 are also shown in FIG. 17.

TABLE 2

| | Material of | Magnetic Properties | |
|---|---|---|---|
| No. | I Type Magnetic Core | $\mu i$ | Bs(1) |
| Example 4 | Mn—Zn ferrite | 2,400 | 490 mT |
| Example 7 | Mn—Zn ferrite | 15,000 | 450 mT |
| Example 8 | Silicon Steel Plate(2) | 20,000 | 1,250 mT |
| Example 9 | Sundust Dust Core | 100 | 100 mT |

Note:
(1) Saturation magnetic flux density (unit: mT) at 800 A/m.
(2) Containing 6.5 weight % of Si.

As is clear from FIG. 17, a greater decease in the leakage flux can be achieved when a magnetic material of higher permeability is used in the I type magnetic core piece than in the E type magnetic core piece. It is thus preferable that when the I type magnetic core piece attached to an outer surface of the E type magnetic core piece is produced from a magnetic material different from that of the E type magnetic core piece, the magnetic material of the I type magnetic core piece has higher permeability than that of the E type magnetic core piece.

EXAMPLES 10 AND 11

Figure 18:
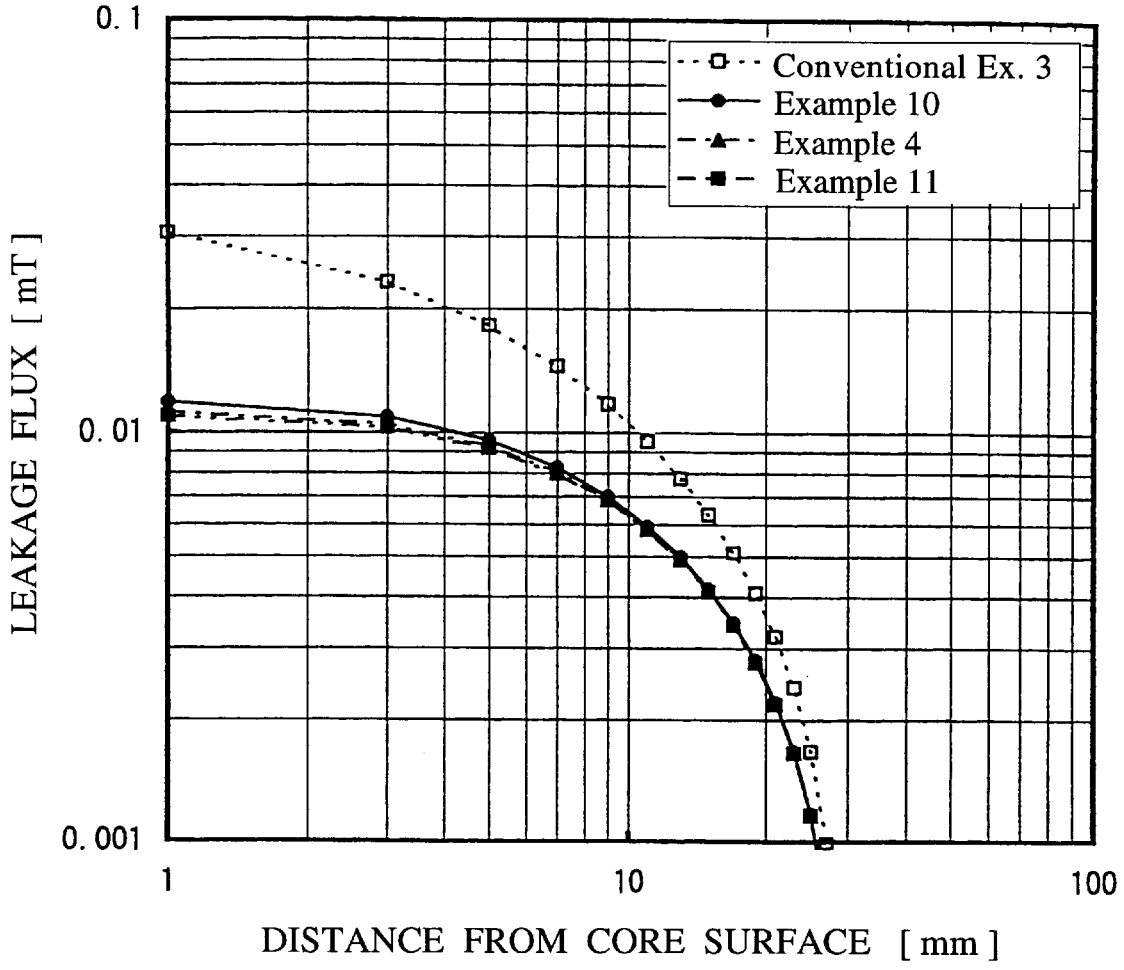
FIG. 18 is a graph showing the relation between a leakage flux and a distance from the core surface in Examples 4, 10 and 11 and Conventional Example 3.

The simulation of a leakage flux was carried out on magnetic cores of the same shape and size as shown in FIG. 13, except that the depth of a recess 45 of the I type magnetic core piece 46 shown in FIG. 4 was changed as shown in Table 3. The material of the magnetic core was Mn—Zn ferrite (initial permeability $\mu i$=2,400, saturation magnetic flux density (800 A/m)=490 mT). The simulation results are shown in FIG. 18. The simulation results of Example 4 and Conventional Example 3 are also shown in FIG. 18.

TABLE 3

| No. | Depth of Recess |
|---|---|
| Example 4 | 1.5 mm |
| Example 10 | 0.5 mm |
| Example 11 | 2.5 mm |

As is clear from FIG. 18, the leakage flux can be effectively decreased by providing a void as a magnetic gap in a root extension area of the intermediate leg portion. Of course, it is necessary that there is a magnetic material in the web portion outside of the magnetic gap. With respect to the depth of the recess 45, the deeper the recess 45, the more the leakage flux decreased, but the effect of suppressing the leakage flux was only slightly increased by deepening the recess 45. This means that it is not particularly necessary to make the recess 45 deeper.

EXAMPLES 12–15

The simulation of a leakage flux was carried out on magnetic cores of the same shape and size as shown in FIG. 13, except that the width of a recess 45 of the I type magnetic core piece 46 shown in FIG. 4 was changed as shown in Table 4. The material of the magnetic core was Mn—Zn ferrite (initial permeability $\mu i$=2,400, saturation magnetic flux density (800 A/m)=490 mT). The simulation results are shown in FIG. 19.

Figure 19:
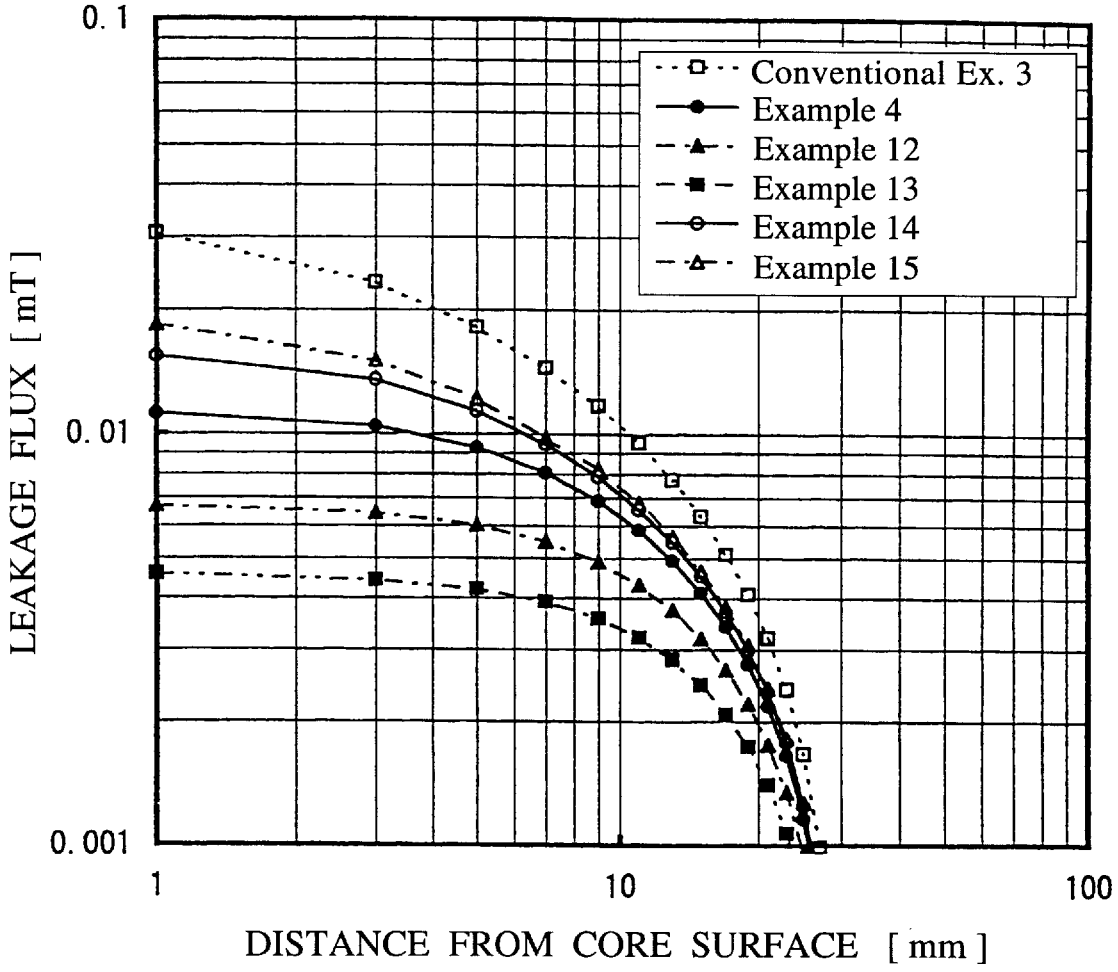
FIG. 19 is a graph showing the relation between a leakage flux and a distance from the core surface in Examples 4 and 12–15 and Conventional Example 3.
Figure 20:
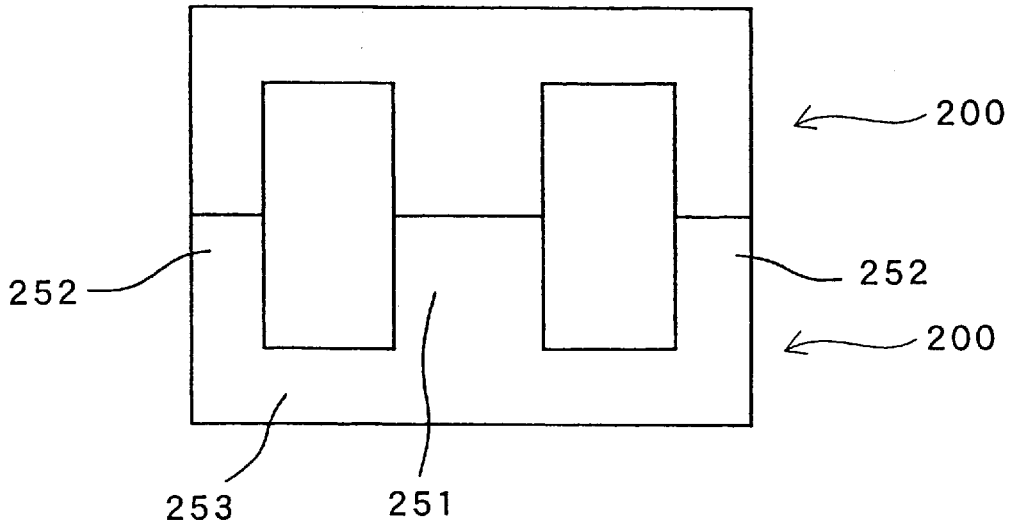
FIG. 20 PRIOR ART
FIG. 20 is a front view showing a conventional E—E type magnetic core.
Figure 21:
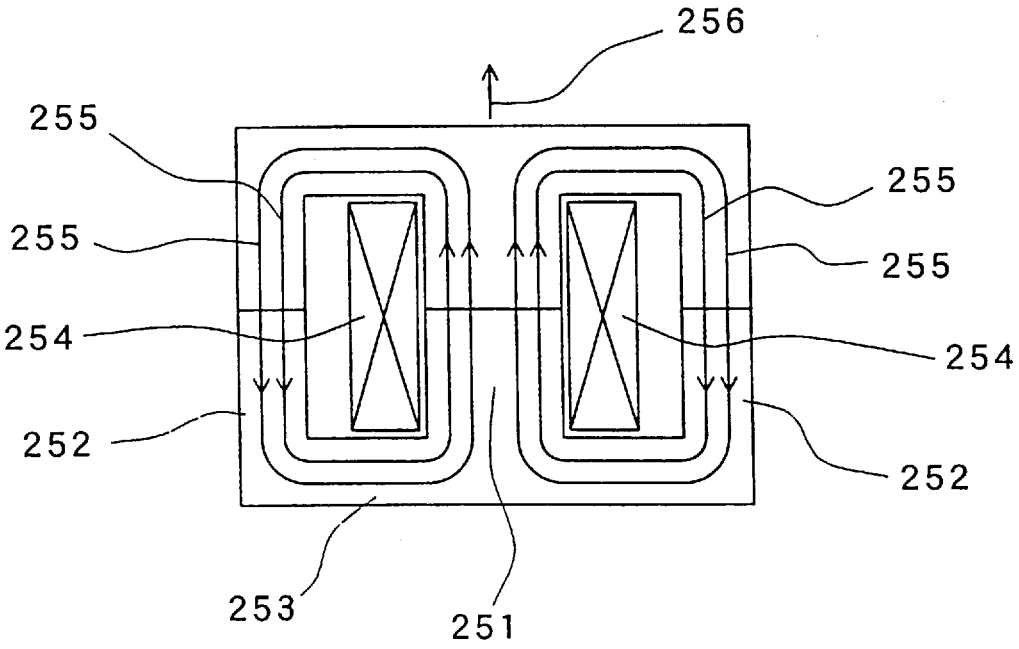
FIG. 21 PRIOR ART
FIG. 21 is a view showing the flow of a magnetic flux in a conventional E—E type magnetic core.
Figure 22:
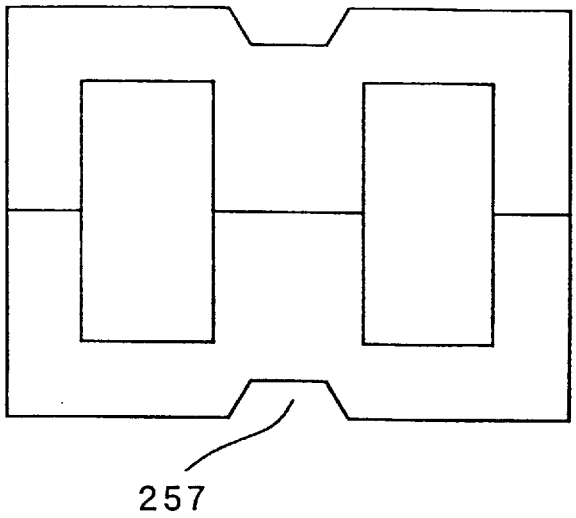
FIG. 22 PRIOR ART
FIG. 22 is a front view showing a conventional E—E type magnetic core.

The simulation results of Example 4 and Conventional Example 3 are also shown in FIG. 19.

TABLE 4

| No. | Width of Recess |
|---|---|
| Example 4 | 10 mm |
| Example 12 | 18 mm |
| Example 13 | 24 mm |
| Example 14 | 5 mm |
| Example 15 | 2 mm |

As is clear from FIG. 19, the wider the recess 45, the more the leakage flux decreased. Though it was possible to decrease the leakage flux even when the width of the recess 45 was less than half of the width of the intermediate leg portion 41, the effect of decreasing the leakage flux was small. This means that the recess 45 is preferably as wide as half or more of the intermediate leg portion 41. Of course, the recess 45 may be wider than the intermediate leg portion 41.

APPLICABILITY IN INDUSTRY

In the magnetic core comprising a first leg portion around which a wire is wound, a second leg portion for circulating a magnetic flux generated in the first leg portion, and a web portion connecting the first leg portion and the second leg portion, a magnetic flux leaking outwardly from the magnetic core in a rear area extending from the first leg portion can extremely be reduced by providing a magnetic gap in the root extension area of the first leg portion according to the present invention. Thanks to a decrease in the leakage flux, the generation of noises is suppressed, contributing not only to increase in the efficiency of transformers, etc. but also to prevention of adverse effects on ambient circuit elements. The magnetic cores of the present invention having such effects are effective for reducing a leakage flux at 50–60 Hz, thus suitable for transformers used in power factor improving circuits, particularly for power supply transformers for CRT color monitors.

What is claimed is:

1. A magnetic core comprising at least one magnetic core piece comprising a first leg portion around which a wire is wound, a second leg portion for circulating a magnetic flux generated in said first leg portion, and a web portion connecting said first leg portion and said second leg portion, said web portion being provided with a magnetic gap in a root extension area extending from the root of said first leg portion, and at least a portion of said magnetic gap being positioned outside the center line of said root extension area.

2. The magnetic core according to claim 1, wherein said magnetic gap is a void.

3. The magnetic core according to claim 1, wherein a cross-sectional area of said magnetic gap is half or more of a cross-sectional area of said first leg portion.

4. The magnetic core according to claim 1, wherein said magnetic gap is formed by a magnetic material having a lower permeability than that of said magnetic core piece.

5. The magnetic core according to claim 1, wherein said magnetic gap is provided by attaching a pair of magnetic core pieces, at least one of which has a recess, to each other, one magnetic core piece outside of said magnetic gap being made of a magnetic material having higher permeability than that of the other magnetic core piece inside of said magnetic gap.

6. The magnetic core according to claim 1, wherein said magnetic gap is a through hole having a rectangular cross section, the width of said through hole being half or more of the width of said first leg portion.

7. The magnetic core according to any one of claims 1–6, wherein said magnetic gap has a symmetrical shape with respect to the center axis of said first leg portion.

8. A magnetic core comprising (a) a first magnetic core piece comprising a first leg portion around which a wire is wound, a second leg portion for circulating a magnetic flux generated in said first leg portion, and a web portion connecting said first leg portion and said second leg portion, and (b) a second magnetic core piece attached to said web portion of said first magnetic core piece, a recess being provided in at least one of said first and second magnetic core pieces on an interface of both magnetic core pieces, and said recess being located in a root extension area extending from the root of said first leg portion.

9. A magnetic core comprising (a) a pair of E type magnetic core pieces each comprising a first leg around which a wire is wound, second leg portions for circulating a magnetic flux generated in said first leg portion, and a web portion connecting said first leg portion and said second leg portions, and (b) at least one I type magnetic core piece, a pair of said E type magnetic core pieces being attached to each other such that their respective first leg portions and second leg portions abut each other, said I type magnetic core piece being attached to an outer surface of said web portion of at least one E type magnetic core piece, a recess being provided in at least one of said E type magnetic core pieces and said I type magnetic core piece on an interface of both magnetic core pieces, and said recess being located in a root extension area extending from the root of said first leg portion of said E type magnetic core piece.

10. The magnetic core according to claim 9, wherein said I type magnetic core piece is formed by a magnetic material having a higher permeability than that of said E type magnetic core piece.

* * * * *